US007882977B2

(12) United States Patent
Johnson

(10) Patent No.: US 7,882,977 B2
(45) Date of Patent: Feb. 8, 2011

(54) FITMENT ASSEMBLY FOR A CONTAINER HAVING A TAMPER INDICATION BAND ATTACHED THERETO

(75) Inventor: James Johnson, Delaware, OH (US)

(73) Assignee: Liqui-Box Corporation, Worthington, OH (US)

( * ) Notice: Subject to any disclaimer, the term of this patent is extended or adjusted under 35 U.S.C. 154(b) by 710 days.

(21) Appl. No.: 10/566,537

(22) PCT Filed: Jul. 30, 2004

(86) PCT No.: PCT/CA2004/001436

§ 371 (c)(1),
(2), (4) Date: Sep. 11, 2006

(87) PCT Pub. No.: WO2005/012129

PCT Pub. Date: Feb. 10, 2005

(65) Prior Publication Data

US 2007/0181578 A1 Aug. 9, 2007

(51) Int. Cl.
*B65D 17/28* (2006.01)
*B65D 17/32* (2006.01)

(52) U.S. Cl. ..... 220/268; 220/276; 220/290; 220/790; 220/802; 215/214; 215/256; 215/318; 215/344

(58) Field of Classification Search ..... 215/214, 215/252–258, 344, 355–364, 318; 220/268, 220/269, 276, 266, 290, 790, 802, 265; 383/66
See application file for complete search history.

(56) References Cited

U.S. PATENT DOCUMENTS 3,223,269 A * 12/1965 Williams ..... 215/318
3,438,529 A * 4/1969 Lohrer ..... 215/320
3,441,161 A * 4/1969 Van Baarn ..... 215/235
3,592,349 A * 7/1971 Baugh ..... 215/307
3,927,784 A * 12/1975 Cochrane ..... 215/256
3,991,904 A * 11/1976 Davis et al. ..... 215/256
4,147,268 A * 4/1979 Patel et al. ..... 215/252
4,166,552 A * 9/1979 Faulstich ..... 215/256
4,172,533 A * 10/1979 Montgomery ..... 215/216
4,231,486 A * 11/1980 Bock ..... 220/266
4,291,813 A * 9/1981 Allen et al. ..... 215/252

(Continued)

FOREIGN PATENT DOCUMENTS

WO WO 3066467 A1 * 8/2003

(Continued)

*Primary Examiner*—Anthony Stashick
*Assistant Examiner*—Ned A Walker

(57) ABSTRACT

A tamper evident fitment assembly for use with a container for flowable material, the closure comprising a cap and a spout secured to the container, the cap having a frangible tamper evident band, the cap having an annular recess for frictionally engaging a top portion of the spout, the cap and spout having cooperating detent and locking elements so that the assembly in a first position where the cap is removably sealed to the spout and the tamper evident band is not broken when the cap is removed for filling may move to a second position when the cap is removably sealed to the spout and the tamper evident band is broken upon removal of the cap. An important feature of the present invention is that the cap frictionally engages a top portion of the spout. No screw threads or similar securing means are required to retain the cap on the spout.

6 Claims, 7 Drawing Sheets

U.S. PATENT DOCUMENTS 4,299,330 A * 11/1981 Walter ..... 220/288
4,305,517 A 12/1981 Dennis
4,362,255 A * 12/1982 Bond ..... 222/107
4,371,089 A 2/1983 Barendregt
4,380,304 A * 4/1983 Anderson ..... 220/782
4,421,146 A * 12/1983 Bond et al. ..... 141/349
4,444,340 A * 4/1984 Bond et al. ..... 222/498
4,445,550 A 5/1984 Davis et al.
4,506,795 A * 3/1985 Herr ..... 215/252
4,531,650 A * 7/1985 Friendship ..... 215/256
4,546,892 A * 10/1985 Couput ..... 215/252
4,562,931 A * 1/1986 Brach et al. ..... 215/220
4,566,601 A * 1/1986 Kuenzig ..... 215/45
4,589,561 A * 5/1986 Crisci ..... 215/256
4,598,833 A * 7/1986 Herr ..... 215/220
4,613,052 A * 9/1986 Gregory et al. ..... 215/252
4,625,875 A * 12/1986 Carr et al. ..... 215/232
4,657,153 A * 4/1987 Hayes ..... 215/252
4,708,259 A * 11/1987 Olimpio ..... 220/790
4,771,904 A * 9/1988 Perne et al. ..... 215/252
4,813,578 A * 3/1989 Gordon et al. ..... 222/541.1
4,899,897 A * 2/1990 Buttiker et al. ..... 215/228
4,919,286 A * 4/1990 Agbay, Sr. ..... 215/235
4,934,546 A * 6/1990 Markley ..... 215/256
4,936,475 A * 6/1990 Montgomery ..... 215/252
5,009,323 A 4/1991 Montgomery et al.
5,036,991 A * 8/1991 Wallman ..... 215/256
5,074,425 A * 12/1991 Wustmann et al. ..... 215/252
5,076,453 A * 12/1991 Odet ..... 215/252
5,143,235 A * 9/1992 Repp ..... 215/256
5,207,783 A * 5/1993 Burton ..... 215/256
5,257,705 A * 11/1993 de Santana ..... 215/252
5,285,912 A * 2/1994 Molinaro ..... 215/256
5,299,702 A * 4/1994 Kneer et al. ..... 215/256
5,303,837 A 4/1994 Adams et al.
5,348,183 A * 9/1994 Luch et al. ..... 220/265
5,456,375 A 10/1995 May
5,465,876 A * 11/1995 Crisci ..... 222/153.1
5,564,582 A * 10/1996 Kamath ..... 215/252
5,593,055 A * 1/1997 Repp et al. ..... 215/256
5,597,082 A * 1/1997 Luch et al. ..... 215/44
5,678,714 A * 10/1997 Guglielmini ..... 215/252
5,680,970 A * 10/1997 Smith et al. ..... 222/514
5,690,243 A * 11/1997 Molinaro ..... 215/329
5,692,628 A * 12/1997 Montgomery et al. ..... 215/43
5,711,441 A * 1/1998 Adams et al. ..... 215/48
5,711,443 A * 1/1998 Bennett ..... 215/256
5,720,402 A * 2/1998 May ..... 215/252
5,730,309 A * 3/1998 Jiradejnunt et al. ..... 220/276
5,738,231 A * 4/1998 Montgomery ..... 215/44
5,740,933 A * 4/1998 Conti et al. ..... 215/256
5,749,484 A * 5/1998 Trout ..... 215/219
5,829,613 A * 11/1998 Wohlgemuth et al. ..... 215/256
5,857,580 A * 1/1999 Iidaka ..... 215/256
5,954,215 A * 9/1999 Alter ..... 215/318
5,960,992 A * 10/1999 Bernstein et al. ..... 222/83.5
5,975,321 A * 11/1999 Luch ..... 215/256
6,029,834 A * 2/2000 Sanner ..... 215/215
6,039,196 A * 3/2000 Ekkert et al. ..... 215/216
6,041,953 A * 3/2000 Goodall ..... 215/354
6,085,921 A * 7/2000 Brown ..... 215/252
6,102,227 A * 8/2000 Cochrane ..... 215/256
6,105,802 A * 8/2000 French et al. ..... 215/318
6,279,779 B1 * 8/2001 Laciacera et al. ..... 222/83
6,338,414 B1 * 1/2002 Schellenbach ..... 215/252
6,347,785 B1 * 2/2002 Copp et al. ..... 251/149.6
6,398,075 B1 * 6/2002 Laciacera et al. ..... 222/91
6,439,412 B2 * 8/2002 Luch ..... 215/318
6,464,093 B1 * 10/2002 Takano ..... 215/252
6,637,725 B2 * 10/2003 Davis et al. ..... 251/149.6
6,702,134 B2 * 3/2004 Scalese et al. ..... 215/344
6,793,082 B1 * 9/2004 Long, Jr. ..... 215/252
6,820,764 B2 * 11/2004 Miani et al. ..... 222/83
6,991,123 B2 * 1/2006 Druitt et al. ..... 215/341
7,014,055 B2 * 3/2006 Kano et al. ..... 215/344
7,114,625 B2 * 10/2006 Jones et al. ..... 215/318
7,487,951 B2 * 2/2009 Johnson ..... 251/149.1
2001/0027957 A1 * 10/2001 Kano ..... 215/341
2002/0179605 A1 * 12/2002 Miani et al. ..... 220/277
2002/0179875 A1 * 12/2002 Davis et al. ..... 251/149.6
2002/0190021 A1 * 12/2002 Luch ..... 215/256
2003/0026508 A1 * 2/2003 Smith et al. ..... 383/80
2003/0155361 A1 * 8/2003 Jones et al. ..... 220/288
2004/0256424 A1 * 12/2004 Johnson ..... 222/518
2005/0035322 A1 * 2/2005 Davis et al. ..... 251/149.1
2005/0161425 A1 * 7/2005 Morini ..... 215/204
2005/0184105 A1 * 8/2005 Johnson ..... 222/568
2006/0213935 A1 * 9/2006 Johnson et al. ..... 222/563
2007/0289937 A1 * 12/2007 Kaneko et al. ..... 215/252

FOREIGN PATENT DOCUMENTS

WO WO 2004085283 A1 * 10/2004
WO WO 2005075311 A1 * 8/2005

* cited by examiner

FITMENT ASSEMBLY FOR A CONTAINER HAVING A TAMPER INDICATION BAND ATTACHED THERETO

FIELD OF THE INVENTION

The present invention provides a tamper evident fitment assembly and more particularly a tamper evident fitment assembly for use in aseptic packaging applications.

BACKGROUND OF THE INVENTION

Many systems are used for filling and dispensing liquids and other flowable products from packages produced under aseptic conditions. Generally these packages are made from a plastic material and have at least one spout through which the liquid or flowable material is filled and dispensed. It is critical that package or seal tampering be readily apparent upon inspection for aseptically packaged food products, and the tampering indicator must be robust enough to withstand the packaging, transporting, filling and sealing conditions. The packaging used in these circumstances is relatively inexpensive and is only meant for single use. Nevertheless it is important that such packaging maintain its aseptic integrity until the packaged goods are consumed and any failure of the aseptic or hermetic seal prior to use of the package contents must be readily apparent. Generally it is preferred that these packages be kept under aseptic conditions throughout the manufacturing and filling process, as well as prior to dispensing of the liquid or flowable product. Such conditions may be required if the flowable product will readily undergo deterioration or degradation when exposed to a non-aseptic environment.

Often the systems used for packaging under aseptic conditions involve the production of the bag and fitment at one facility and then transporting them to a second facility for filling during which the bag is then placed in an aseptic environment. It can be difficult to maintain such aseptic conditions throughout this process.

It is therefore desirable to provide a tamper evident fitment assembly for use in aseptic applications that addresses the requirements discussed above.

SUMMARY OF THE INVENTION

The present invention provides a tamper evident closure and dispensing assembly that includes a spout and a cap with a tamper indicating band that may be assembled into a pre-cap position and attached to a container under sterile/aseptic conditions and transported to a filling facility. During transportation the pre-cap position will maintain the container in an aseptic condition. When filling of the container is required, the container is placed in a filling station which is maintained under aseptic conditions and the cap is removed from the spout. The container is then filled and the cap is placed back on the spout in a full cap position. Removal of the cap from the full cap position will separate the tamper indicating band from the cap thereby indicating that the seal on the container has been broken.

The present invention provides a tamper evident closure and dispensing assembly for use with a fluid dispensing container for flowable material. The assembly comprises a spout for attachment to a container, the spout having an upper end and a lower end, and having a dispensing passage therethrough. The assembly further comprises a cap having a top with an external depending skirt and a tamper indicating band releasably attached to the skirt. The cap further including an internal skirt depending from the top and spaced inwardly from the external skirt and operable to be received within the fluid passage to provide a seal between the cap and the spout. The assembly has a first position in which the cap is received on the upper end of the spout with the tamper indicating band abutting the external rib and the internal skirt being received within the passage and providing a seal therebetween, and a second position In which the cap is located on the lower end of the spout with the external rib located between the external skirt and the tamper indicating band and the upper end of the spout located adjacent the top of the cap, the internal skirt being received within the passage and providing a seal there between.

The present invention further provides a tamper evident closure and dispensing assembly comprising a spout having an upper end and a lower end, the spout defining a dispensing passage therethrough and a cap sized to be received on the spout and having a tamper indicating band releasably attached thereto. The assembly has a first position in which the cap and the tamper indicating band are received on the upper end of the spout and a seal is provided between the cap and the spout and from which when the cap is removed the tamper indicating band remains attached to the cap, and a second position in which the cap and the tamper indicating band are located adjacent the lower end of the spout and a seal is provided between the cap and the spout and from which when the cap is removed the tamper indicating band detaches from the cap and remains on the spout, thereby-providing evidence that the assembly has been tampered with.

An important feature of the present invention is that the cap frictionally engages a top portion of the spout. No screw threads or similar securing means are required to retain the cap on the spout.

In another aspect of the invention there is provided a tamper evident closure and dispensing assembly for use with a container for flowable material, the closure comprising a cap and a spout secured to the container, the cap having a frangible tamper evident band associated with it, the cap having an annular recess for frictionally engaging and retaining a top portion of the spout, the cap and spout having cooperating detent and locking elements to allow the assembly, when secured to a container to move from a first position where the cap is removably sealed to the spout and the tamper evident band is not broken when the cap is removed for filling, to a second position when the cap is removably sealed to the spout and the tamper evident band is broken upon removal of the cap to dispense flowable material.

In another aspect of the invention there is provided a tamper evident closure and dispensing assembly, wherein the cap includes an internal skirt depending from a top portion of the cap and spaced inwardly from the cap sidewall, the frangible tamper evident band depends from the lower edge of the cap sidewall and the area between the sidewall and the internal skirt forms the annular recess in the cap and includes a lower and-an upper detent that determine the pre-cap and full cap positions, respectively for the top portion of the spout that is sealingly engaged within the annular recess of the cap when the assembly is in use.

In another aspect of the invention there is provided a tamper evident closure and dispensing assembly, wherein the cap includes a locking ring that cooperatively and removably engages an annular projection located on an inner edge of the tamper evident band in the pre-cap position and in the full cap position, the annular projection located on an inner edge of the tamper evident band is engaged beneath the locking ring, whereby in the pre-cap position the frangible tamper evident band is not broken upon removal of the cap, but in the full cap position, the frangible tamper evident band must be broken to remove the cap.

In another aspect of the invention there is provided a tamper evident closure and dispensing assembly, wherein the cap includes a locking ring and at least one tab that cooperatively engage and lock an annular projection located on an inner edge of the tamper evident band in the pre-cap position and in the full cap position the annular projection located on an inner edge of the tamper evident band is engaged and locked between the locking ring and the at least one tab, whereby in the pre-cap position the frangible tamper evident band is not broken upon removal of the cap, but in the full cap position, the frangible tamper evident band must be broken to remove the cap.

DESCRIPTION OF THE DRAWINGS

The present invention is better understood with reference to the attached description and to the following Figures, wherein.

DETAILED DESCRIPTION OF THE INVENTION

Figure 1A:
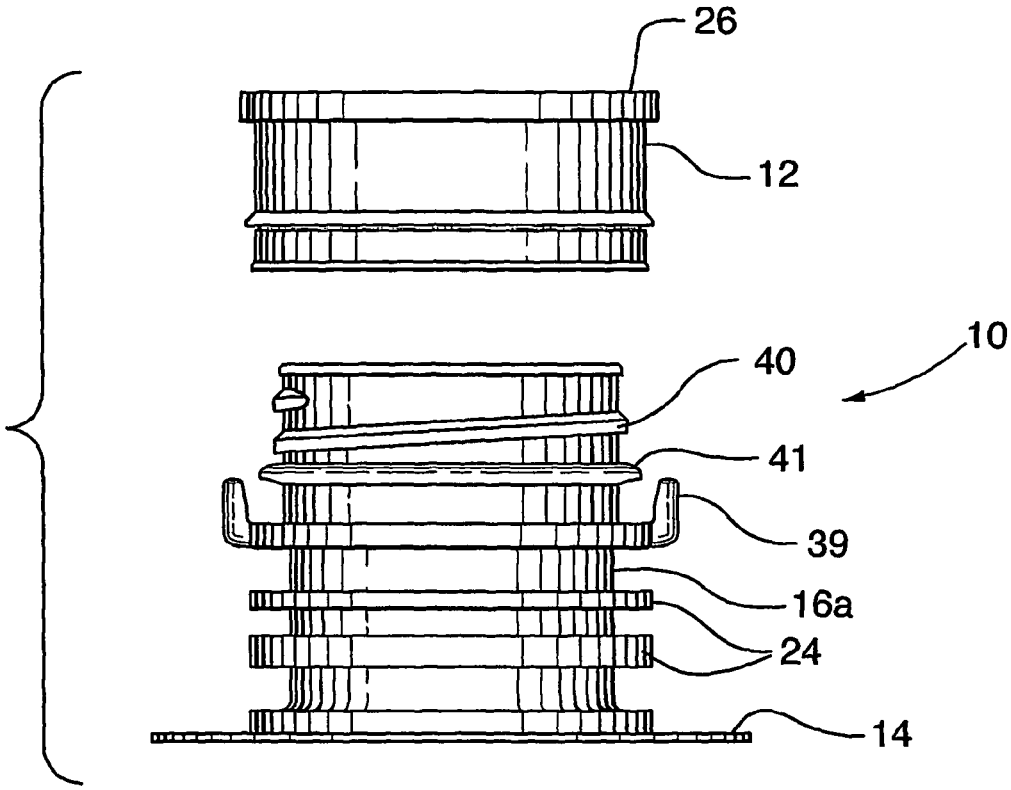
FIG. 1A illustrates a front view of one embodiment of the tamper evident fitment assembly of the present invention in a ready to assemble position.
Figure 1B:
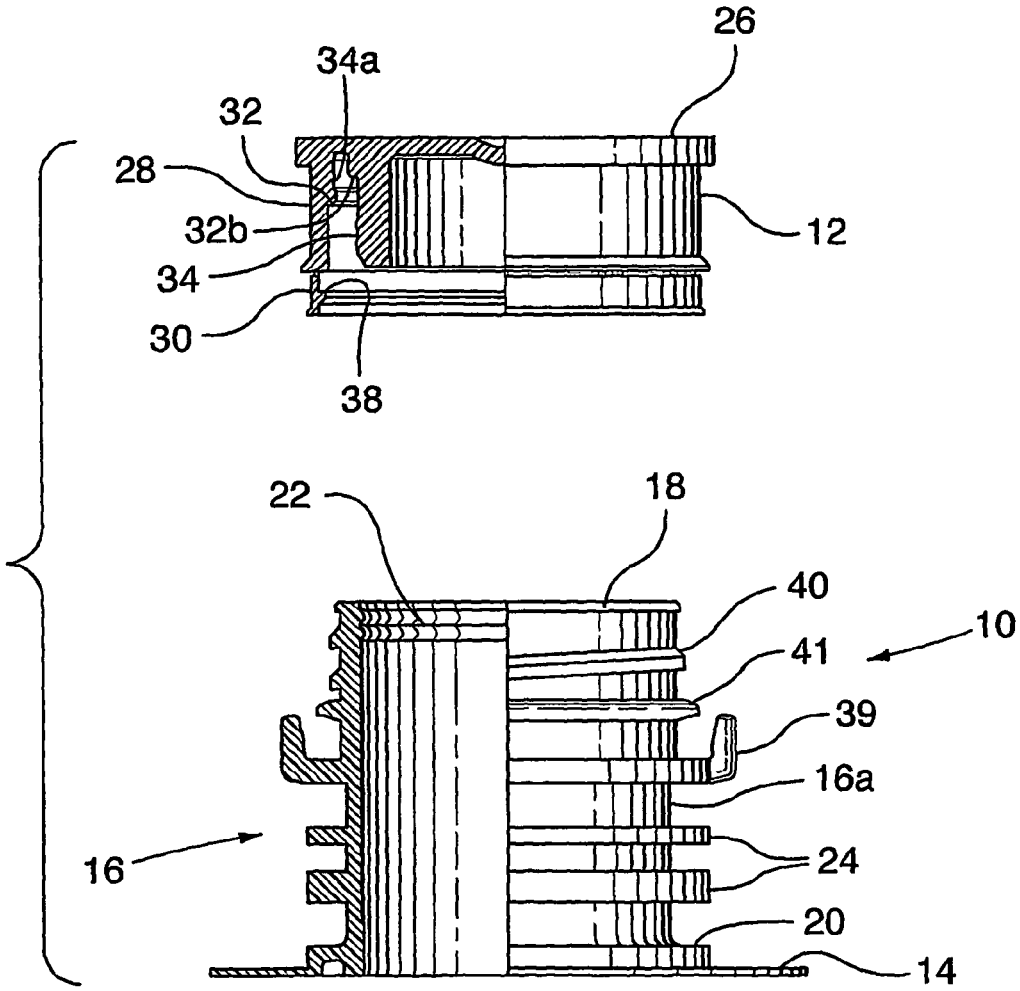
FIG. 1B illustrates a side partial cross sectional view of the tamper evident fitment assembly of FIG. 1A.

The tamper evident fitment assembly of the present invention will now be described with reference to FIGS. 1A through 6 in which one embodiment of the tamper evident fitment assembly is indicated generally at numeral 10. The tamper evident fitment assembly 10 is connected to a container that is filled with flowable material, e.g. liquids. It will be understood by a person skilled in the art that generally a container for such use may be in the form of a pouch. As used herein, the term "flowable material" does not include gaseous materials, but encompasses materials which are flowable under gravity or may be pumped. Such materials include liquids, preferably foods, such as water, fruit juice, milk, oil; emulsions e.g. ice cream mix, soft margarine; pastes e.g. meat pastes, peanut butter; preserves e.g. jams, pie fillings, marmalade; jellies; doughs; ground meat e.g. sausage meat; powders e.g. gelatin powders, detergents; granular solids e.g. nuts, sugar, and like materials. The invention described herein is particularly useful for flowable foods.

The tamper evident fitment assembly 10 of the present invention may be used on a container that requires handling and filling in an aseptic environment. The fitment assembly and its use will be described in such an environment. However, it will be understood by a person skilled in the art, that the use of the fitment assembly of the present invention is not limited to such a use and other applications fall within the scope of the invention.

The tamper evident fitment assembly 10 includes a cap 12 and a spout 16 having an annular flange 14 at its base that is operable for attachment to a container, not shown. The attachment of the flange 14 to a container can be achieved many ways that will be known to a person skilled in the art. Examples of ways to attach the flange 14 to the fitment include, but are not limited to, heat sealing, welding and chemical bonding, e.g. adhesive. The cap 12 is sized to be received on the spout 16, and can be located on the spout 16 in several different positions in which hermetic sealing between the cap 12 and the spout 16 is maintained to provide an aseptic environment. The positions include an aseptic pre-cap position and an aseptic full cap position, which will be described further below.

As can be seen more clearly in FIGS. 2 through 6, the spout 16 has an upper end 18 and a lower end 20 and a central passage 22 through the spout 16 between the upper end 18 and the lower end 20 for passage of flowable material.

In the illustrated embodiment, the spout 16 also includes a series of different sized valve engagement rings 24 that allow the spout and hence the container to be secured to a variety of fillers or dispensers, not shown. The size and location of each ring 24 may be selected in accordance with the type of filler and/or dispenser the spout 16 is attached to. It will be understood by a person skilled in the art that the positioning and size of the rings 24 may be varied for optimizing the securing of the spout 16 to such apparatus. Spout regions 16*a* are provided between the valve engagement rings 24 to receive and secure the dispensing or filler valves. The spout 16 may include two valve engagement rings 24; however it will be understood by a person skilled in the art that the number may vary depending on the end use of the container and fitment assembly 10. The spout 16 may also include external threads 40 for a threaded connection of the spout 16 to a dispensing connector.

As described above, the cap 12 is sized to be received on the spout 16 and includes a top 26 with an external skirt 28 depending from the top 26 and a tamper indicating band 30 releasably attached to the external skirt 28 at the opposite end from the top 26. The external skirt 28 has an internal ledge 32 located adjacent the top 26 of the cap 12, distal from the tamper indicating band 30. The cap 12 further includes a cork 34, also referred to as an internal skirt, depending from the top and spaced inwardly from the external skirt 28. The cork 34 is sized to be received within the fluid passage 22 of the spout 16 to provide a seal between the cap 12 and the spout 16 when the cap 12 is received on the spout 16.

Figure 3:
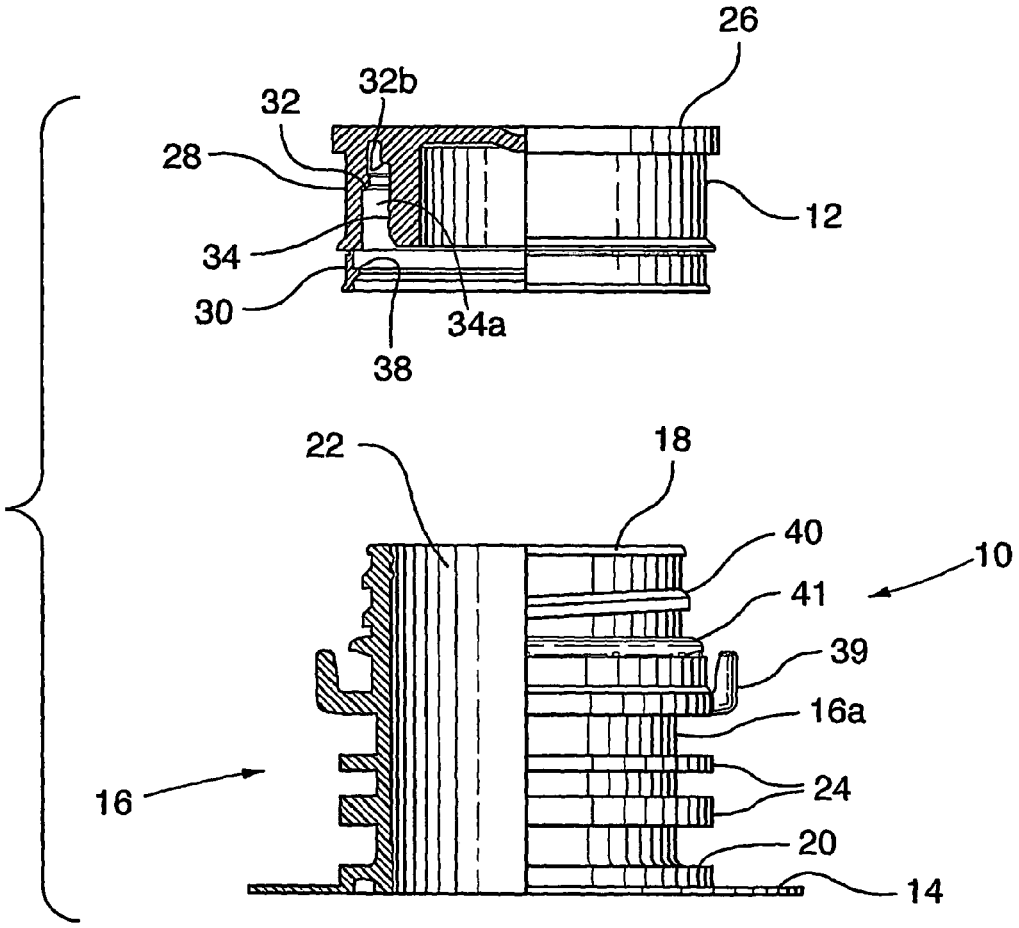
FIG. 3 illustrates a side partial cross sectional view of the tamper evident fitment assembly of FIG. 1A in the filling position.

As can be seen in FIG. 3, the internal skirt 34 is spaced from the external skirt 28 providing a space 34*a* that is sized to allow the spout 16 to fit therebetween. The spacing is sufficient to allow the spout 16 to be placed between the internal skirt 34 and the external skirt 28 and to be held in place by a friction fit and thereby providing a seal therebetween that is sufficient to maintain an aseptic seal for the container. Space 34*a* is configured with a lower internal ledge or detent 32 and an upper internal ledge or detent 32*b*, against which the top of the spout 16 sealingly engages the cap 16 to provide the aseptic seals in the pre-cap and full cap positions as will be described in more detail below.

Figure 1C:
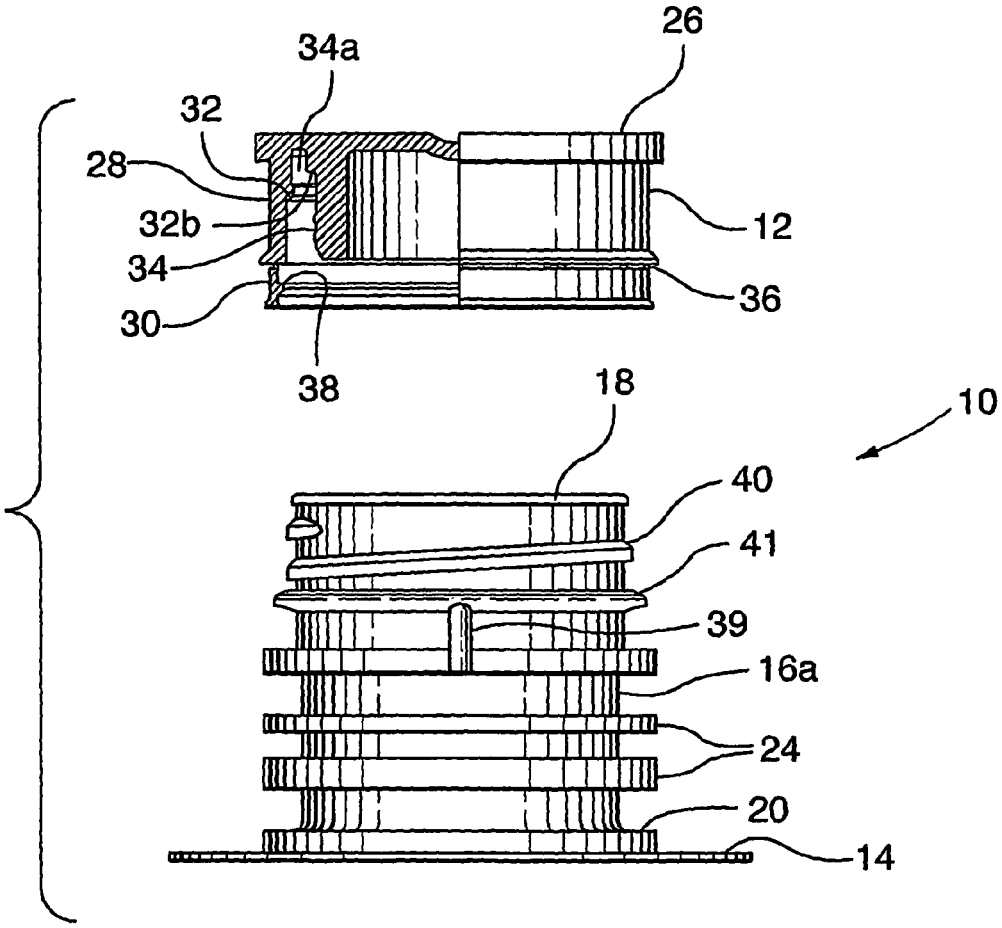
FIG. 1C illustrates a side view of the embodiment of FIG. 1A.
Figure 6:
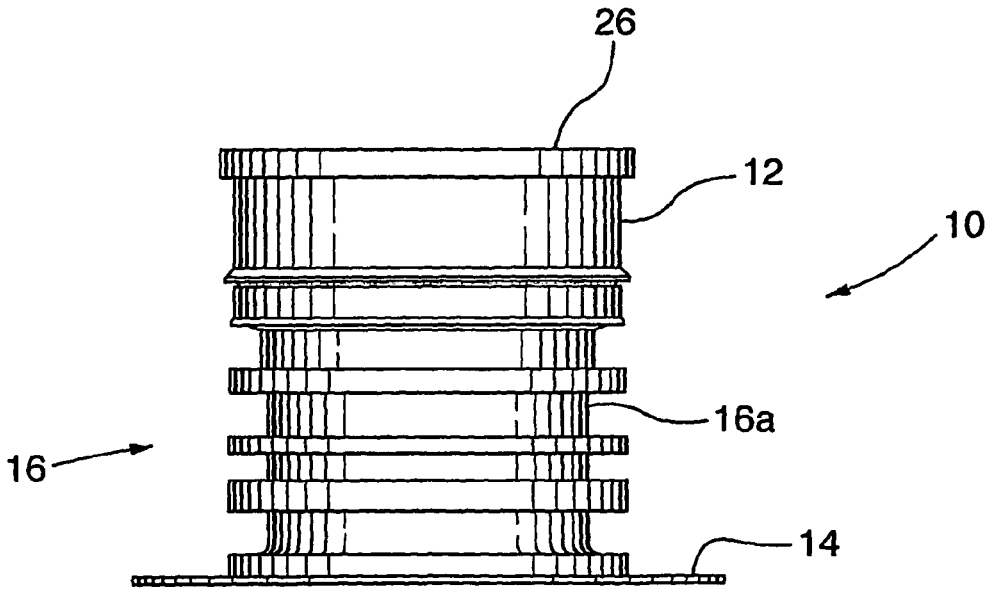
FIG. 6 illustrates a front view of an alternative embodiment of the tamper evident fitment assembly.

As discussed above, the cap 12 includes a tamper indicating band 30 releasably attached to the external skirt 28. The tamper indicating band 30 is attached to the external skirt 28 by a series of frangible bridges 36. The frangible bridges 36 are integrally formed with the cap 12 and band 30. Located on the internal surface of the tamper indicating band 30 is a shoulder 38 that extends inwardly and is located at a distance from the external skirt 28. The shoulder may be continuous around the band perimeter or be interrupted and functions as a tamper evident shoulder as will be described below. The exterior of spout 16 includes a circumferential lip 18. External screw threads 40 are located just below the lip 18. An annular locking ring 41 is located just below the screw threading 40. Locking ring 41 may be continuous or interrupted also. Spaced from and below the locking ring 41 is at least one tab 39, which cooperates with locking ring 41 to engage and retain tamper evident shoulder 38, when the cap 12 is positioned on the spout 16. The at least one tab 39 may be a continuous annular ring or it may comprise a plurality of tabs spaced-about the circumference of the spout 16. In FIG. 1C a side view of the fitment illustrates a shape of the tab 39. It will be noted that this tab may not be necessary for all applications and FIG. 6 illustrates an embodiment of the fitment that does not include a tab 39. Below the at least one tab 39 are the two valve engagement rings 24. As indicated previously, these rings 24 permit a variety of dispensing or filler valves, not shown to be secured to the spout. Finally, below the rings 24 is the base 20 or bottom of the spout 16 which includes the flange 14 by which the spout 16 may be secured to a container, not shown, by well known means. The distance between the shoulder 38 and the external skirt 28 in the cap 12 is sized to receive at least a portion of the external rib 39 there between.

As can be seen in FIGS. 2 through 6, the cap 12 and the spout 16 have many possible positions during the use of the fitment 10. The positions of the cap 12 and the spout 16 will be discussed in order of the operation of the fitment beginning with a ready to assemble position to a dispensing position. In all of the positions discussed the spout 16 is attached to a container, not shown, by means that are known to a person skilled in the art.

Figure 2A:
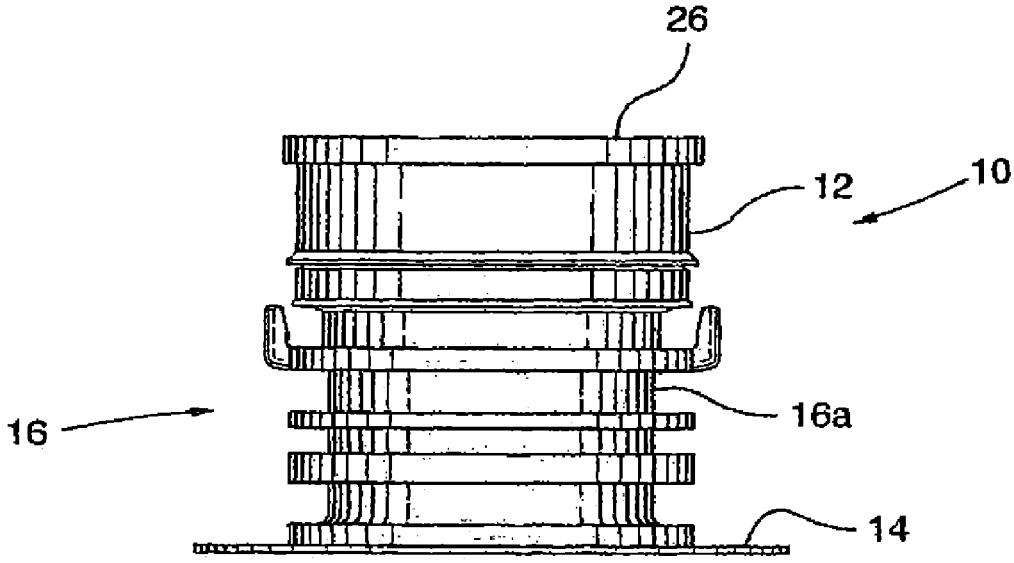
FIG. 2A illustrates a front view of the tamper evident fitment assembly of FIG. 1A in a pre-cap position.

FIG. 2 illustrates the ready to assemble position in which the cap 12 is not yet placed on the spout 16. In this position the tamper indicating band 30 is connected to the external skirt 28 of the cap 12 by frangible bridges 36.

Figure 2B:
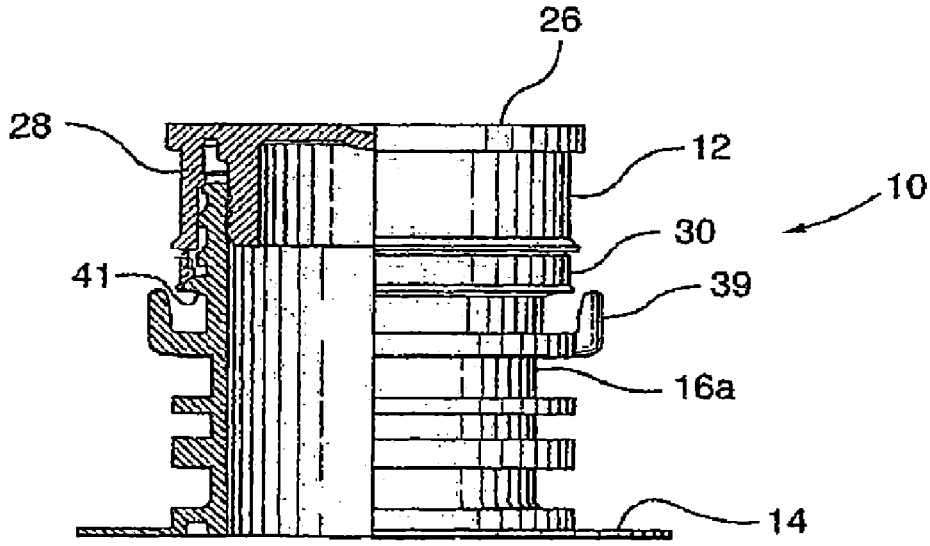
FIG. 2B illustrates a side partial cross sectional view of the tamper evident fitment assembly of FIG. 2A.

Turning to FIG. 2B, the pre-fill position is shown. As can be seen, the cap 12 is received on the spout 16 with the tamper indicating band 30 being located adjacent the locking ring 41. Shoulder 38 rests against locking ring 41; while lip 18 of the spout is frictionally and sealingly engaged by ledge 32 in the area 34*a* of cap 12. In this pre-fill position the tamper indicating band 30 is connected to the external skirt 28 of the cap 12 by frangible bridges 36. The positioning of the internal skirt 34 within the passage 22 adjacent the internal ledge 32, will maintain an aseptic seal between the cap 12 and the spout 16.

In order to fill the container with the required flowable material the cap 12 must be removed from the spout 16 in order to allow for the flowable material to pass through the passage 22. The cap 12 is removed from the spout 16, as shown in FIG. 3, while maintaining the connection between the tamper indicating band 30 and the external skirt 28 of the cap 12. The container may then be filled by means known by a person skilled in the art, an example of which is described below.

Figure 4A:
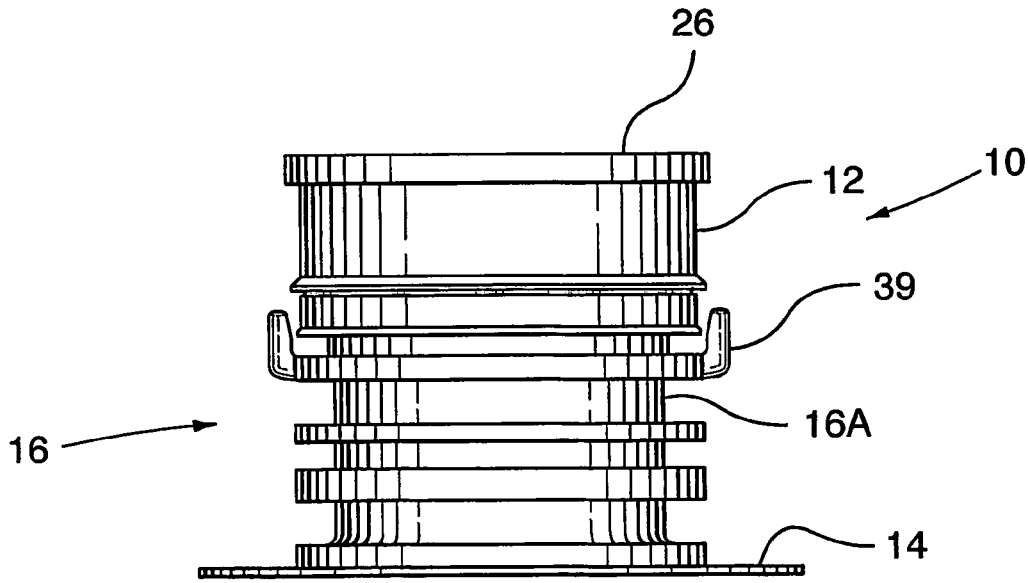
FIG. 4A illustrates a front view of the tamper evident fitment assembly of FIG. 1A in a full cap position.
Figure 4B:
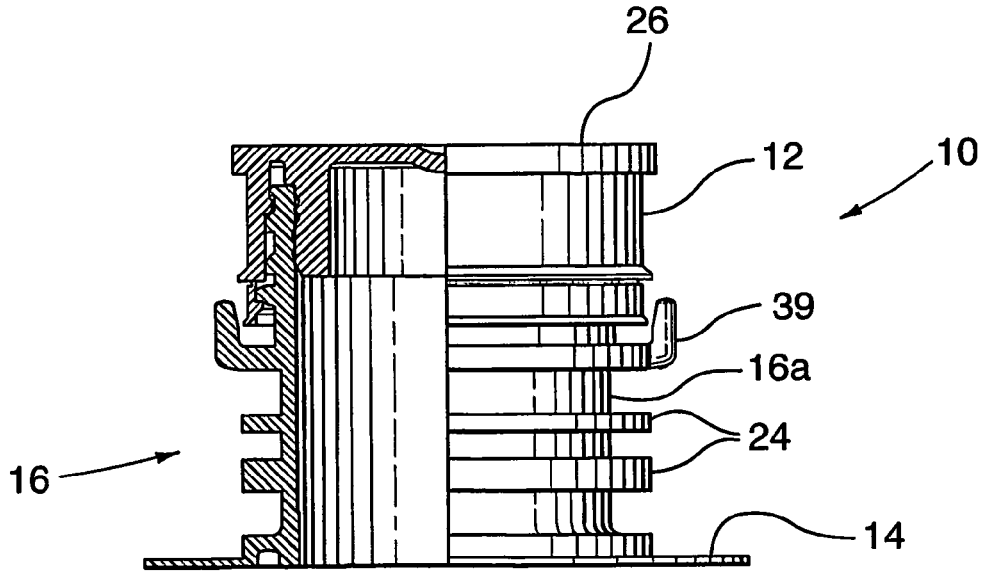
FIG. 4B illustrates a side partial cross sectional view of the tamper evident fitment assembly of FIG. 4A.

Once the container has been filled, the cap 12 is then placed back onto the spout 16. FIG. 4B illustrates the assembly at this time which may be called the full cap or post fill position. At this stage the cap 12 is generally not removed from the spout 16 until dispensing of the product from the container is required. Since any tampering with the container and fitment assembly 10 at this stage may contaminate the contents of the container it is desirable to show whether the fitment assembly 10 has been tampered with. FIG. 4B illustrates the full cap position in which an aseptic environment for the fitment assembly 10 and the contents of the container may be maintained. If the cap 12 is removed from the fitment assembly 10 when in the full cap position the tamper evident band 30 will separate, as described below, indicating that tampering has occurred and providing the required signal upon inspection.

When the cap 12 is placed on the spout 16 in the full cap position the cap 12 is moved further onto the spout 16 towards the flange 14 than in the previously described pre-cap position, illustrated in FIG. 2B. In the full cap position, the cap 12 is positioned with the shoulder 38 of the tamper indicating band 30 located below the rib 41 and the frangible bridges 36 are located adjacent the peripheral edge of the external rib 39. In this position the upper end or lip 18 of the spout 16 is located above the internal ledge 32 of the external skirt 28 on the cap 12. Similar to the pre-cap position, in the full cap position, the location of the internal skirt 34 in the passage 22 creates a seal between the cap 12 and the spout 16 and provides an aseptic environment for the container, its contents and fitment assembly 10.

Figure 5:
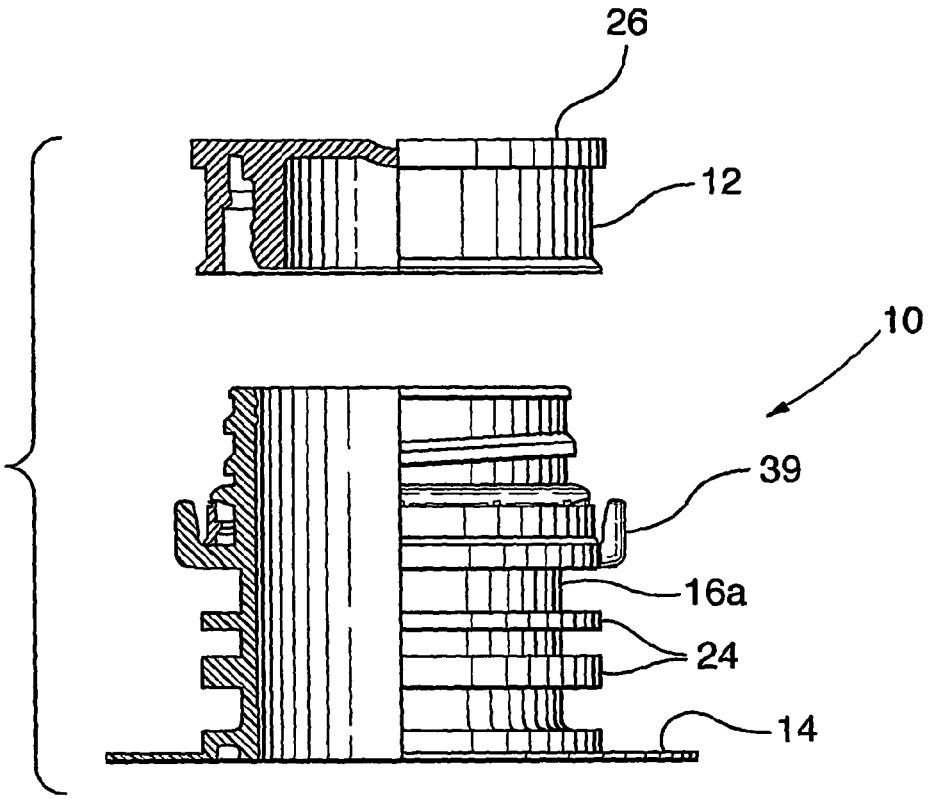
FIG. 5 illustrates a side partial cross sectional view of the tamper evident fitment assembly of FIG. 1 in a dispensing position.

When the flowable material is required to be dispensed from the container the cap 12 must be removed from the spout 16. FIG. 5 illustrates the cap 12 and spout 16 once the cap 12 has been removed from the spout 16. In this dispensing position, the cap 12 has been pulled away from the spout 16 in order to allow for the removal of material from the container. As the cap 12 is pulled away from the spout 16 the shoulder 38 will abut against the external rib 39 which will inhibit the upward movement of the shoulder 38 and thereby inhibit the removal of the tamper indicating band 30 from the spout 16. The force that is applied on the cap 12 to pull it away from the spout 16 while the shoulder 38 of the tamper indicating band 30 is retained beneath the external rib 39 will apply pressure to the frangible bridges 36. Once sufficient pressure/force has been applied to the cap 12 the frangible bridges 36 will sever and the tamper indicating band 30 will become detached from the cap 12. The cap 12 can then be removed and the material in the container dispensed. The tamper indicating band 30 will remain on the spout 16 beneath the external rib 39 and indicate to a user that the fitment assembly 10 has been tampered with. The tamper indicating band 30 may subsequently be removed if required by the user.

The assembly and use of the tamper evident fitment assembly 10 will now be briefly discussed. The spout 16 and cap 12 are manufactured separately by suitable means known in the art. After manufacture the spout 16 and cap 12 are shipped to the container manufacturing location. The spout 16 is attached to the container, not shown, at flange 14 by suitable means known in the art. After attachment of the spout 16, the cap 12 is placed on the spout 16 in the pre-cap position, described above. The container and fitment assembly 10 are irradiated, by suitable means known in the art, in order to create an aseptic environment in the container. The container with the fitment assembly 10 may then be shipped to a filling station. When filling of the container is required, the container is placed in a filling machine, which operates under aseptic conditions. Once in the filling machine a capper apparatus will remove the cap 12 from the pre-cap position with the tamper indicating band 30 still attached to the cap 12. The filling machine will then fill the container with flowable material through the fluid passage 22 until the container is full. At this time, the cap 12 will be placed back onto the spout 16 and pushed into the full cap position. The container may then be removed from the filling machine and stored or shipped, as required. When the cap 12 is removed from the full cap position the tamper indicating band 30 will separate from the external skirt 28 thereby indicating that the fitment assembly 10 has been tampered with. The types of filling machines and the operation of such machines will be understood by a person of skill in the art.

The fitment assembly 10 may be made from any suitable material known by a person skilled in the art. For example, the spout 16 and the cap 12 may be made from any suitable plastic, in particular any plastic suitable for injection molding, which will be known by a person skilled in the art. Examples include, but are not limited to, linear low density polyethylene and polypropylene. Generally the cap may be made of a plastic that has sufficient flexibility to allow the spout 16 to move past the lower indent 32 to achieve the full cap position.

It will also be understood by a person skilled in the art that the dimensions of the spout 16 and cap 12 may vary depending on the filling machine with which the container is to be used. When varying the dimensions the relative size of the spout 16 to the cap 12 must be maintained in order to provide the friction fit between the two and thereby maintaining an aseptic environment when required.

Although the invention has been described in terms of a particular preferred embodiment thereof, the skilled practitioner will understand that variations may be made within the scope of the appended claims.

The invention claimed is:

1. A tamper-evident assembly for use with a fluid dispensing container for flowable material, the assembly comprising:

(A) an annular flange, for attachment to a container;

(B) a spout, projecting upwardly from the annular flange and having an upper end and a lower end, the spout defining a dispensing passage therethrough and having at least one external annular rib; and (C) a cap, having a top with an external depending skirt and a frangible tamper indicating band releasably attached to the skirt, the cap further including an internal skirt depending from the top and spaced inwardly from the external skirt and operable to be received within the fluid passage to provide a seal between the cap and the spout;

wherein the assembly has a first pre-cap position in which the cap is received on the upper end of the spout, with the frangible tamper indicating band positioned above the external annular rib and abutting a top surface of the external annular rib, and the internal skirt being received within the passage and contacting an internal annular surface of the spout providing a seal between the internal skirt and the internal annular surface of the spout; and wherein the assembly has a second full-cap position in which the cap is located on the lower end of the spout, with the external annular rib being located between the external skirt and the tamper indicating band, and the upper end of the spout being located adjacent the top of the cap, the internal skirt being received within the passage and providing a seal therebetween;

wherein the cap and spout have cooperating detent and locking elements to allow the assembly, when secured to a container, to move from:

(a) a first pre-cap position, where the cap is removably sealed to the spout and the tamper evident band is not broken when the cap is removed for filling, to:

(b) a second full-cap position when the cap is removably sealed to the spout providing that the tamper evident band is broken upon removal of the cap from its second full-cap position to dispense flowable material from the container;

wherein the assembly in the first pre-cap position or the second full-cap position provides an aseptic seal between the cap and the spout;

wherein the cap is received on the upper end of the spout for the pre-cap position or the full-cap position by a push-on process; and wherein the cap is removed from the spout either from the pre-cap position or the full-cap position by a pull-off process.

2. A tamper-evident assembly, as recited in claim 1 for use with a fluid dispensing container for flowable material, wherein the assembly has a first pre-cap position, in which the cap and the tamper indicating band are received on the upper end of the spout, a seal is provided between the cap and the spout, and when the cap is removed from the spout, the frangible tamper indicating band remains attached to the cap; and wherein the assembly has a second full-cap position, in which the cap and the tamper indicating band are located adjacent the lower end of the spout, wherein a seal is provided between the cap and the spout, and when the cap is removed from the spout, the tamper indicating band detaches from the cap and remains on the spout, thereby providing evidence of tampering.

3. The tamper-evident assembly as recited in claim 1, wherein said spout comprises an external screw thread at a top of said spout for attachment to a dispensing connector.

4. A tamper-evident closure and dispensing assembly for use with a container for flowable material, the closure comprising:

(A) a cap having a top with an external depending skirt and a frangible tamper indicating band releasably attached to the skirt, the cap further including an internal skirt depending from the top and spaced inwardly from the external skirt and operable to be received within the fluid passage to provide a seal between the cap and the spout; and (B) a spout secured to the container, projecting upwardly from an annular flange and having an upper end and a lower end, the spout defining a dispensing passage therethrough and having at least one external annular rib;

(C) an annular flange, for attachment to a container;

wherein the cap has an annular recess for frictionally engaging a top portion of the spout;

wherein the assembly has a first pre-cap position in which the cap is received on the upper end of the spout, with the frangible tamper indicating band positioned above the external annular rib and abutting a top surface of the external annular rib, and the internal skirt being received within the passage and contacting an internal annular surface of the spout providing a seal between the internal skirt and the internal annular surface of the spout;

wherein the assembly has a second full-cap position in which the cap is located on the lower end of the spout, with the external annular rib being located between the external skirt and the tamper indicating band, and the upper end of the spout being located adjacent the top of the cap, the internal skirt being received within the passage and providing a seal therebetween;

wherein the cap and spout have cooperating detent and locking elements to allow the assembly, when secured to a container, to move from:

(a) a first pre-cap position where the cap is removably sealed to the spout and the tamper evident band is not broken when the cap is removed for filling, to:

(b) a second full-cap position when the cap is removably sealed to the spout providing that the tamper evident band is broken upon removal of the cap from its second full-cap position to dispense flowable material from the container;

wherein the assembly in the first pre-cap position or the second full-cap position provides an aseptic seal between the cap and the spout;

wherein the cap is received on the upper end of the spout for the pre-cap position or the full-cap position by a push-on process; and wherein the cap is removed from the spout either from the pre-cap position or the full-cap position by a pull-off process.

5. A tamper-evident closure and dispensing assembly as recited in claim 4;

wherein the cap includes an internal skirt depending from a top portion of the cap and spaced inwardly from the cap sidewall;

wherein the frangible tamper-evident band depends from the lower edge of the cap sidewall; and wherein the area between the sidewall and the internal skirt forms the annular recess in the cap and includes a lower and an upper detent that determine the first pre-cap position and second full-cap position, respectively for the top portion of the spout that is sealingly and frictionally engaged within the annular recess of the cap when the assembly is in use.

6. A tamper-evident closure and dispensing assembly, as recited in claim 5;

wherein the spout includes a locking ring that cooperatively engages an annular projection located on an inner edge of the tamper evident band in the first pre-cap position;

wherein in the second full-cap position the annular projection located on an inner edge of the tamper evident band is engaged beneath the locking ring on the spout; and whereby in the first pre-cap position, the frangible tamper-evident band is not broken upon removal of the cap, but in the second full-cap position, the frangible tamper-evident band must be broken to remove the cap.

* * * * *